US007686233B2

(12) United States Patent
Scribner et al.

(10) Patent No.: US 7,686,233 B2
(45) Date of Patent: Mar. 30, 2010

(54) SYSTEMS AND METHODS FOR DISPENSING AN ANTI-TRACTION, MOBILITY DENIAL MATERIAL

(75) Inventors: Cliff J. Scribner, San Antonio, TX (US); Geronimo I Elias, Jr., Lytle, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/370,869

(22) Filed: Mar. 9, 2006

(65) Prior Publication Data

US 2006/0266283 A1 Nov. 30, 2006

Related U.S. Application Data

(62) Division of application No. 10/845,166, filed on May 14, 2004, now Pat. No. 7,186,443.

(51) Int. Cl.
*B05B 9/00* (2006.01)

(52) U.S. Cl. ..... 239/143; 239/318; 239/345; 239/361; 239/379; 239/419; 239/424; 222/195; 222/464.2; 222/637; 137/590; 137/888

(58) Field of Classification Search ..... 239/424, 239/142–144, 172, 318, 340, 345, 346, 349–351, 239/355, 360, 361–363, 364–369, 371, 379, 239/419, 419.5, 650–664, 668; 222/81–83.5, 222/195, 464.2, 630, 637; 137/590, 888
See application file for complete search history.

(56) References Cited

U.S. PATENT DOCUMENTS

| | | | | | |
|---|---|---|---|---|---|
| 1,447,095 | A * | 2/1923 | McArthur | 239/304 |
| 3,592,270 | A * | 7/1971 | Livingston | 169/16 |
| 3,840,074 | A * | 10/1974 | Clark | 169/24 |
| 3,983,213 | A | 9/1976 | Lissant | |
| 4,069,186 | A | 1/1978 | Ramig | |
| 4,586,854 | A * | 5/1986 | Newman et al. | 406/153 |
| 4,673,516 | A | 6/1987 | Berry | |
| 4,742,958 | A * | 5/1988 | Bucceri | 239/2.2 |
| 4,830,762 | A * | 5/1989 | Yamaguchi et al. | 252/2 |
| 5,639,796 | A | 6/1997 | Lee | |
| 6,034,041 | A | 3/2000 | Nittel et al. | |
| 6,642,351 | B1 * | 11/2003 | Harlukowicz et al. | 528/502 R |
| 7,405,184 | B2 * | 7/2008 | Mathis et al. | 508/471 |

* cited by examiner

*Primary Examiner*—Christopher S Kim
(74) *Attorney, Agent, or Firm*—Grossman, Tucker et al

(57) ABSTRACT

Systems and methods for dispensing an anti-traction, mobility denial material on a target surface. In various exemplary embodiments, a method of dispensing an anti-traction material on a target surface includes providing a polymer particle powder to a first section of a dispensing nozzle, providing a water stream to a second section of a dispensing nozzle, and mixing the polymer particle powder with the water stream upon exit of the streams out of the first and second sections of the dispensing nozzle to form the anti-traction material on the target surface, the formed anti-traction material being a gel.

12 Claims, 6 Drawing Sheets

SYSTEMS AND METHODS FOR DISPENSING AN ANTI-TRACTION, MOBILITY DENIAL MATERIAL

CROSS-REFERENCE TO RELATED APPLICATION

This is a Divisional of application Ser. No. 10/845,166 filed May 14, 2004 now U.S. Pat. No. 7,186,443. The entire disclosure of the prior application is hereby incorporated by reference herein in its entirety.

The U.S. Government has a paid-up license in this invention and the right in limited circumstances to require the patent owner to license others on reasonable terms as provided by the terms of U.S. Government Contract No. V674P-2995, Delivery Order No. 674-W10091, and U.S. Government Contract No. M67854-02-D-1087, Delivery Order No. 0001, awarded by the United States Marine Corps.

BACKGROUND OF THE INVENTION

1. Field of Invention

This invention relates to systems and methods for dispensing an anti-traction, mobility denial material onto a surface.

2. Description of Related Art

Crowd and riot control is a concern for law officials at every level of government. Typical attempts of crowd control often depend upon physical force to subdue and disperse crowds. Such physical force includes batons, rubber bullets, water cannons, kinetic energy rounds and the like.

Non-lethal weapon systems now represent an important alternative for law enforcement officials and strategic defense purposes. Examples of non-lethal weapons include, but are not limited to, tear gas, flash grenades, acoustic guns, sticky foams, snare nets, stun guns, strobe lights, malodorants, and the like. However, these typical non-lethal controls have disadvantages. For instance, crowd barriers can be bulky, require advance planning to move them into place, require large storage areas when not in use, and can be destroyed or used as weapons by the crowd members, etc. Typical barriers may also be besieged by vehicles driven by crowd members. Crowd controls such as tear gas and malodorants, although non-lethal, may still cause physiological and/or psychological injury to both law enforcement agents and crowd members. Further, tear gas and malodorants may not impede forward progress of determined rioters.

Moreover, sticky foams are difficult to apply and may be difficult to remove once the crowd has dispersed. For example, most conventional compressed air-foam systems, such as the systems employed in the firefighting industry, use high pressure nitrogen gas stored in vessels at 2000-4000 psig as the transport media. These high pressure gas storage systems require significant expertise and care when handled to avoid accidents.

SUMMARY OF THE INVENTION

In view of the above, an anti-traction material (ATM) that impedes the mobility and access of personnel and/or vehicles to areas that are to be defended or protected may be desired. Such exemplary anti-traction materials are disclosed in U.S. patent application Ser. No. 10/727,615, which is incorporated herein by reference in its entirety. As disclosed in application Ser. No. 10/727,615, the anti-traction material generally includes at least a plurality of polymer or acrylic copolymer particles and water or the like substance. Generally, the polymer or acrylic polymer/copolymer particles are in a very fine dry powder-like form. Preferably, the anti-traction material is made by combining or mixing water with the acrylic polymer/copolymer powder at the time of application to a target surface. Following application on the target surface, and upon hydration of the acrylic polymer/copolymer particles, the anti-traction material typically produces a coherent, visco-elastic gel that resists vertical slump and displacement by gravitational forces and forces of foot and vehicle traffic.

However, if the acrylic polymer particle powder is mixed with water in the delivery system prior to dispensing, gellation and/or clogging of the parts of the delivery system will likely occur. Thus, water and the acrylic polymer particle powder are kept separated until dispensed.

This invention provides systems and methods for dispensing two or more materials, such as water and an acrylic polymer particle powder, onto a target surface to form an anti-traction, mobility denial material on the target surface.

This invention also provides systems and methods for controlling the dispensing flow rate of two or more material steams, such as, for example a water stream and an acrylic polymer particle powder stream forming an anti-traction material on the target surface, based at least on one or more of a size, shape, specific gravity and angle of repose of the acrylic polymer particle, operational characteristics of one or more devices providing motive power to flow the two or more material steams, target area characteristics, and target area size.

This invention also provides systems and methods that use low pressure, high volume air flow to provide or deliver a predetermined flow rate of an acrylic polymer particle powder to a discharge nozzle used for dispensing two or more material steams, such as water and the acrylic polymer particle powder, onto a target surface to form an anti-traction, mobility denial material on the target surface.

This invention further provides systems for dispensing an anti-traction material which are highly mobile and have compact storage space requirements.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail below, with reference to the following figures, in which.

DETAILED DESCRIPTION OF PREFERRED EMBODIMENTS

As discussed above, in one exemplary embodiment, the anti-traction material (ATM) includes two components: a dry polymer powder and water. When these components are properly mixed by weight, a liquid, gel-like substance is formed that, when applied to a surface, makes most surfaces very slippery and nearly impossible to negotiate by foot or wheeled vehicle. Thus, the anti-traction material provides an effective, non-lethal means of controlling the movement of riotous crowds, for providing area denial, and for facilitating non-combatant evacuations in support of peacekeeping operations.

Figure 1:
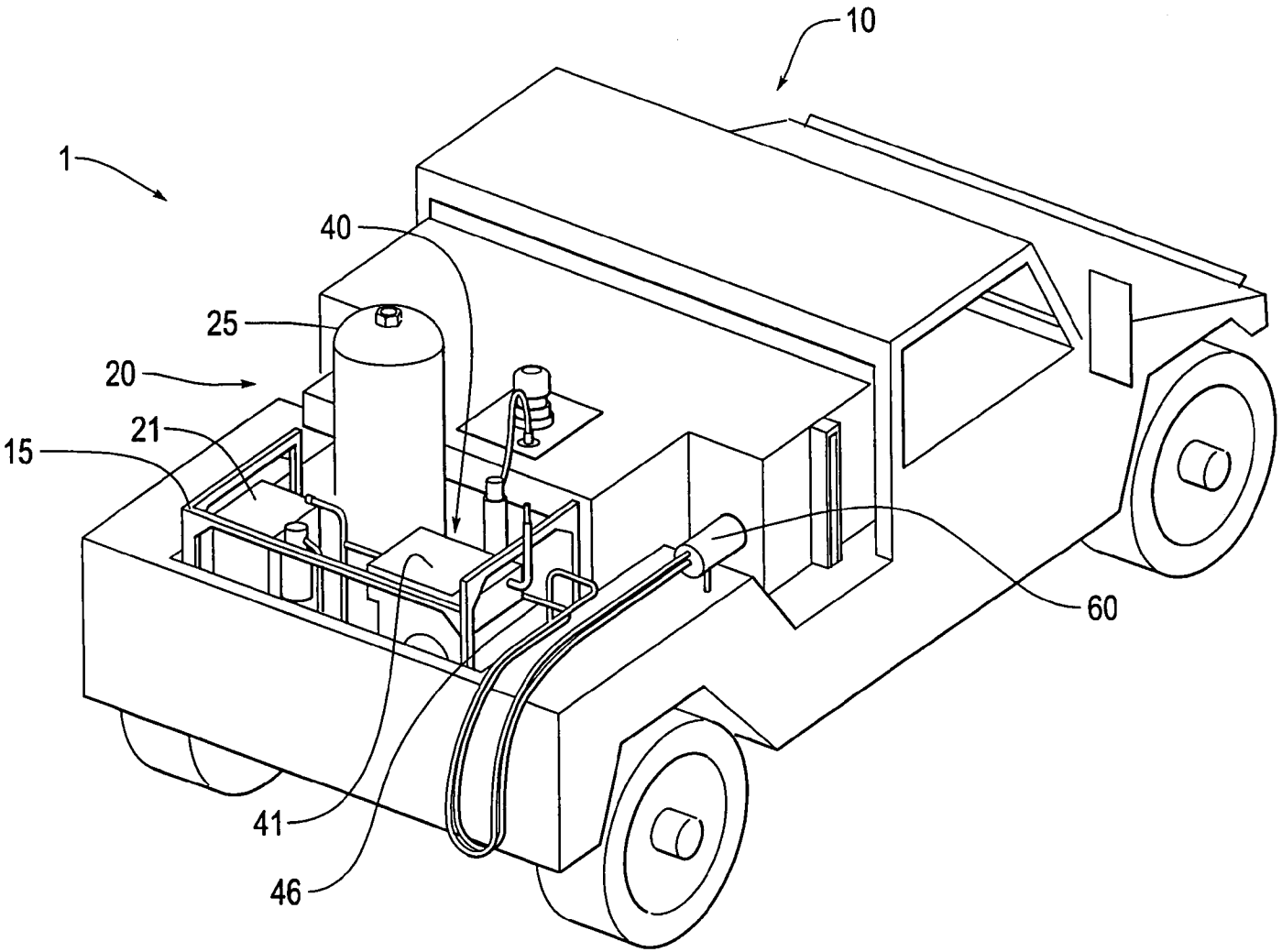
FIG. 1 is a perspective view of an exemplary embodiment of a vehicle-based system for dispensing an anti-traction, mobility denial material on a target surface.

FIG. 1 is a diagram illustrating an exemplary embodiment of a vehicle-based system 1 for dispensing an anti-traction, mobility denial material on a target surface. As shown in FIG. 1, in various exemplary embodiments, the vehicle-based system 1 for dispensing the anti-traction, mobility denial material on the target surface may be housed in a land-based vehicle 10, such as a HMMWV-type land vehicle (High Mobility Multipurpose Wheeled Vehicle) such as, for example an M1123 Series HMMWV or the like. In various exemplary embodiments, system 1 weighs less than about 1100 pounds, excluding the water in a water storage tank 45 and the polymer powder in the powder storage tank 25, and thus can be easily removed and used on other fixed or mobile platforms.

In various exemplary embodiments, the vehicle-based system 1 for dispensing an anti-traction material on a target surface is capable of dispensing a mixed stream of water/polymer powder forming the anti-traction material (ATM) up to about 100 feet, and preferably up to about 70 feet. Further, in various exemplary embodiments, the system 1 can dispense a mixed stream of water/polymer powder over an effective area coverage of approximately 36000 square feet (duration dependent), and may be able to empty a full load between about 10 to about 14 minutes.

With reference to FIGS. 1-4, in various exemplary embodiments, the anti-traction material dispensing system 1 may include a polymer powder dispensing sub-system 20 and a water dispensing sub-system 40, both attached to a frame 15 mounted in the vehicle 10 used as transport means for the anti-traction material dispensing system 1.

In various exemplary embodiments, the polymer powder dispensing sub-system 20 includes a 33 gallon vertically oriented storage tank 25 used for storing the polymer powder. Generally, the dry polymer particle powder may include commercially available dry Polyacrylamide; Cytec A-130 anionic flocculent, having a specific gravity, or S.G., of about 0.83 (6.94 lb./gallon). The dry polymer powder is water soluble and generally non-toxic. In various exemplary embodiments, the particle powder may have a particle size distribution by weight of less than 0.100 mm (100 micron).

In various exemplary embodiments, the polymer powder dispensing sub-system 20 further includes a jet pump assembly 30 (shown in FIG. 4) that includes a modified jet pump 31 coupled to a powder metering/powder fluidizing nozzle or device 32. The jet pump 31 is provided with an annular venturi 35 disposed within the body of the jet pump 31. The powder metering device/nozzle 32 is designed to provide a metered flow rate range of polymer powder to a dispensing or discharging nozzle 60 of the anti-traction material dispensing system 1.

In various exemplary embodiments, the powder metering nozzle 32 may provide a polymer powder flow rate in a range of about 15 to about 35 lb./min. In an exemplary embodiment, the powder metering nozzle 32 may provide a polymer powder flow rate in a range of about 18.3 to about 31.1 lb./min, which corresponds to about 2.63 to about 4.48 gallons per minute of powder.

In various exemplary embodiments, polymer powder flow rate is adjusted by setting the 4.7 HP diesel engine 21 to a different RPM speed, i.e. 400 RPM to 820 RPM (3 psig to 6 psig powder storage tank 25).

In various exemplary embodiments, the polymer powder dispensing sub-system 20 further includes a compressed air system 23 that provides motive air to transport the polymer particle powder from the polymer particle powder storage tank 25 to the dispensing nozzle 60. In various exemplary embodiments, the compressed air system 23 includes a diesel engine 21, such as a 4.7 horsepower (HP) diesel engine, that is used to power an air compressor 22. The compressed air system 23 also includes a timing belt and pulleys that allow the rotational speed of the diesel engine 21 to be reduced to the rotational speed of the air compressor 22. In one exemplary embodiment, the timing belt and pulleys allow the diesel engine 21 shaft rotational speed at full throttle of 3600 rpm to be reduced to approximately 1800 rpm on the shaft of compressor 22.

In various exemplary embodiments, the polymer powder dispensing sub-system air compressor 22 may include, for example, a 5 horsepower (HP) rotary vane air compressor, having a deliverable capacity of about 40 cubic feet per minute (CFM) over an range of about 0 to about 15 psig. Generally, the polymer powder dispensing sub-system 20 operates at about 3 to about 12 psig measured within the powder storage tank 25. In various exemplary embodiments, the polymer powder dispensing sub-system 20 further includes hoses, pipes, valves and fittings, as needed (as shown in FIGS. 1-4).

Figure 5:
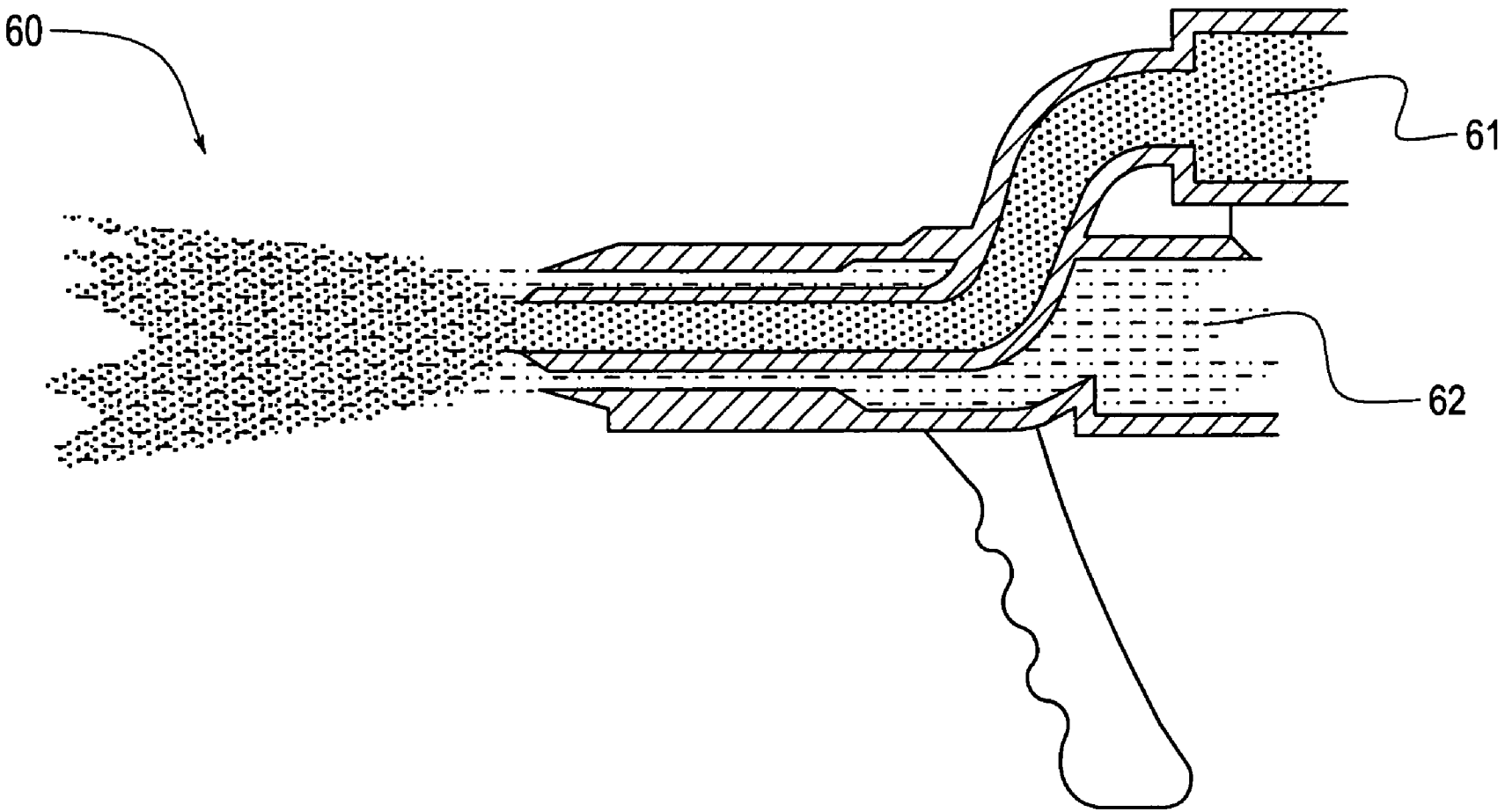
FIG. 5 is a schematic view of an exemplary embodiment of a discharge nozzle subsystem used to dispense the polymer powder and water stream on a target surface.

In various exemplary embodiments, the powder metering nozzle 32 uses a low working pressure, high volume (such as, for example, in a range of about 3 to about 6 psig and 40 about CFM) system to move motive air through the jet pump assembly 30 and out of the dispensing or discharge nozzle 60 (shown in FIG. 5). In one exemplary embodiment, the polymer powder dispensing sub-system includes an air compressor 22 which has a working pressure and flow profile within a range of about 0 to about 15 psig at about 40 CFM.

Figure 4:
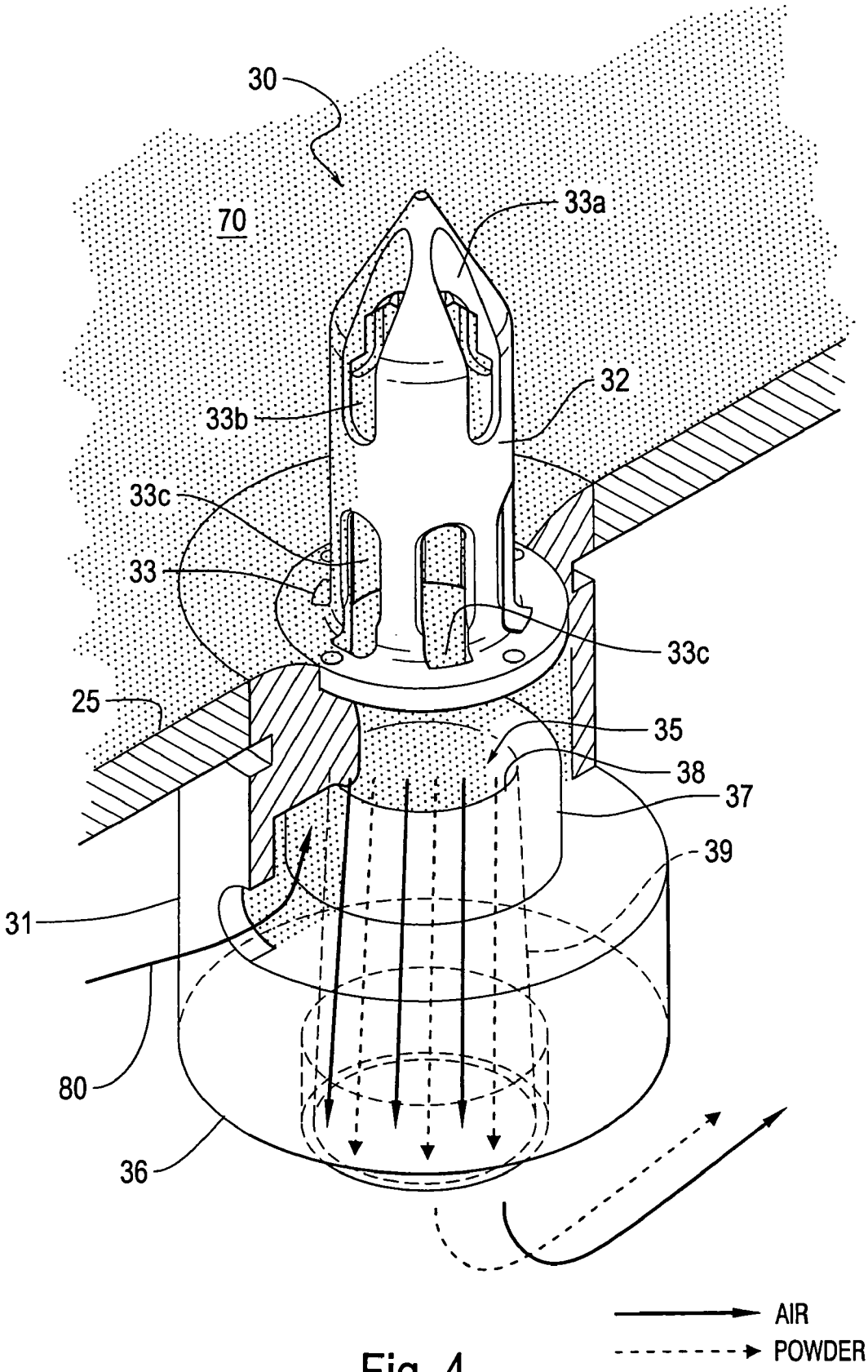
FIG. 4 is a perspective view of an exemplary embodiment of a jet pump assembly coupled to a polymer powder metering nozzle of the system shown in FIG. 1.
Figure 6:
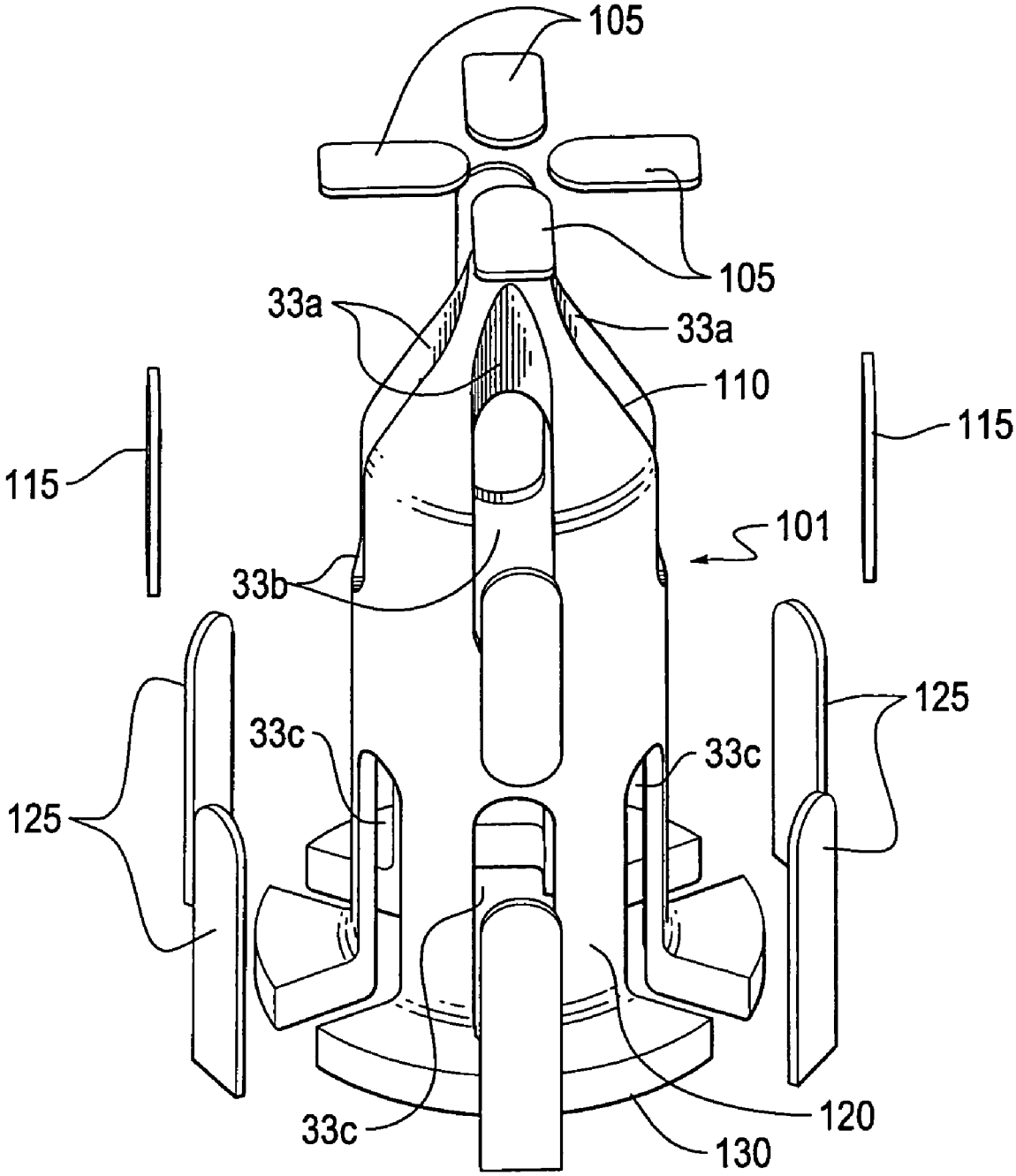
FIG. 6 is a perspective view of an exemplary embodiment of a polymer powder metering nozzle according to this invention.

With reference to FIGS. 4 and 6, in various exemplary embodiments, the powder metering nozzle 32 has an elongated hollow nozzle body 01 that includes a substantially conical upper section 110, a substantially cylindrical lower section 120, and a base section 130. Typically, the power metering nozzle base section 130 is disposed above, and is attached to, the jet pump 31.

In various exemplary embodiments, the powder metering nozzle 32 further includes one or more openings 33*a*-33*c* formed within the elongated hollow nozzle body 101. Openings 33*a*-33*c* provide the passage means for the polymer particle powder to flow from the polymer powder storage tank 25, through the hollow body 101 of the power metering nozzle 32, and toward the annular venturi 35 in the jet pump 31. In various exemplary embodiments, openings 33*a*-33*c* provide the passage means for the polymer particle powder to flow away from the conical upper section 110 and toward the lower section 120 of the powder metering nozzle 32.

The powder metering nozzle 32 has the ability to aspirate with motive air a powder with very small irregularly shaped polymer particle distribution range of approximately 0.100 mm (100 micron) or less, with a specific gravity (S.G.) of approximately 0.60 to 0.80 and with a high angle of repose (flow-ability) within the range of about 60 to 80 degrees.

Further, the powder metering nozzle 32 has the ability to aspirate with motive air an irregularly shaped polymer particle powder having a particle size distribution that is greater than or equal to 0.100 mm, with substantially similar specific gravity and angle of repose.

The inventors have also tested the powder metering nozzle 32 using a spherically shaped synthetic polymer typically used in the powder coating industry. Particle size distribution was 0.100 mm to 0.400 mm with an angle of repose (flowability) of about 10-20 degrees and a S.G. of 0.92. The inventors have found that, under these conditions, powder flows very easily.

Further, the powder metering nozzle 32 design allows for greater air aspiration as a function of powder weight per unit time in order to stop flooding of the jet pump assembly system 30, hoses, fittings and the dispensing/discharge nozzle 60. Moreover, the powder metering nozzle 32 creates a system of controlled powder flow out of the dispensing/discharge nozzle 60 under a variety of air compressor speeds and conditions.

For example, the powder metering nozzle 32 is able to aspirate with motive air polymer powder particles having an angle of repose greater than about 20 degrees. In various exemplary embodiments, the powder metering nozzle 32 can control the amount of powder flow rate, i.e. by weight, that exits the polymer powder storage tank. The powder metering nozzle has no moving parts.

Continuing with reference to FIGS. 4 and 6, the surface area size of openings 33*a*-33*c* formed within the elongated hollow nozzle body 101, and the arrangement, for example positioning, orientation, and the like, of the openings 33*a*-33*c* with respect to the powder metering nozzle body 101, are important considerations in the design of the powder metering nozzle 32 and jet pump 31 forming the jet pump assembly 30. For example, as shown in FIG. 6, in an exemplary embodiment, the powder metering nozzle 32 includes four openings 33*a-b* and six openings 33*c* provided at various portions within the wall of the powder metering nozzle body 101. Openings 33*a-b*, which comprise a combination of openings 33*a* and 33*b*, are formed in the conical section 110 of the powder metering nozzle body 101 and continue to the top section of the powder metering nozzle section 120. Openings 33*c* are formed in the bottom section of the powder metering nozzle portion 120. Generally, openings 33*b* and 33*c*, which form a first plurality of openings, are arranged or disposed tangential to a surface of the cylindrical wall of the powder metering nozzle section 120.

As shown in FIGS. 4 and 6, the surface areas of openings 33*a*, 33*b* and 33*c* may be represented by surface area projections 105, 115 and 125, respectively. In various exemplary embodiments, in order to prevent or minimize flooding of the jet pump assembly, hoses, fittings and the like, the surface areas of the openings 33*a*, 33*b* and 33*c* in the powder metering nozzle 32 are sized according to a cross sectional area 38 of a cavity 39 in the jet pump 31 where the motive air moves through the venturi 35.

In various exemplary embodiments, tangentially arranged openings 33*b* and 33*c*, that is, the first plurality of openings, are sized based on a ratio, R1, of the combined surface areas of openings 33*b* and 33*c* (i.e., surface area projections 115 and 125) to the cross sectional area 38 of the cavity in the jet pump. In various exemplary embodiments, tangential openings 33*b* and 33*c*, i.e., first plurality of openings 33*b* and 33*c*, are sized such that a ratio R1 has a value greater than about 1.5, and preferably greater than about 2.0. In an exemplary embodiment, the inventors have found that, for a jet pump having a cross sectional area 38 of about 2.0 square inches ($in^2$), tangential openings 33*b* and 33*c* with a combined surface area of about 4.6 $in^2$ prevent flooding of the jet pump assembly and provide the means to meter the powder once the system is started.

In various exemplary embodiments, openings 33*a* forming a second plurality of openings are sized based on a second ratio, R2, of the combined surface areas of openings 33*a* (i.e., surface area projections 105) to the cross sectional area 38 of the cavity in the jet pump. In various exemplary embodiments, second plurality of openings 33*a* are sized such that a ratio R2 has a value greater than about 0.25, and preferably greater than about 0.5. In an exemplary embodiment, the inventors have found that, for a jet pump having a cross sectional area 38 of about 2.0 $in^2$, openings 33*a* with a combined surface area of about 1.0 $in^2$ prevent flooding of the jet pump assembly and provide the means to meter the powder once the system is started.

The powder metering nozzle 32 provides the means to deliver the correct flow rate (in lb/min.) of powder to the dispensing/discharge nozzle 60 by means of air aspiration. Generally, powder flow rate is adjusted by setting the 4.7 HP diesel engine 21 to a different RPM speed. For example, using a 400 RPM air compressor 22 speed for a 3 psig powder tank 25 typically provides for approximately 1.1 GPM powder flow out the dispensing/discharge nozzle 60. Further, an exemplary air compressor speed of 650 RPM for a 5 psig powder tank typically provides for an approximately 2.7 GPM powder flow rate out the dispensing/discharge nozzle. At the 650 RPM, the powder metering nozzle 32 provides an exemplary powder flow rate of 18.3 lb/min. of powder to match an exemplary flow rate of 22 GPM (182.6 lb./min.) of water out of the dispensing/discharge nozzle 60. This flow rate also provides an appropriate ratio of water to powder out of the dispensing/discharge nozzle while system 1 is operating. In various exemplary embodiments, the ratio of water to powder out of the dispensing/discharge nozzle ranges from about 7:1 to about 16:1 by weight. In a preferred exemplary embodiment, the ratio of water to powder out of the dispensing/discharge nozzle is about 10:1 by weight.

Further, using a 820 RPM air compressor speed for a 6 psig powder tank provides a flow rate of approximately 3.5 GPM of polymer powder out the dispensing/discharge nozzle. It will be noted that doubling the RPM of the air compressor generally triples the polymer powder flow out of the dispensing/discharge nozzle.

It will be noted that the polymer particle powder is very sensitive to moisture. Therefore, the design and configuration of the powder dispensing sub-system 20 shown in FIGS. 1-3 allows the polymer powder to remain dry prior to exiting the dispensing/discharge nozzle 60.

Figure 2:
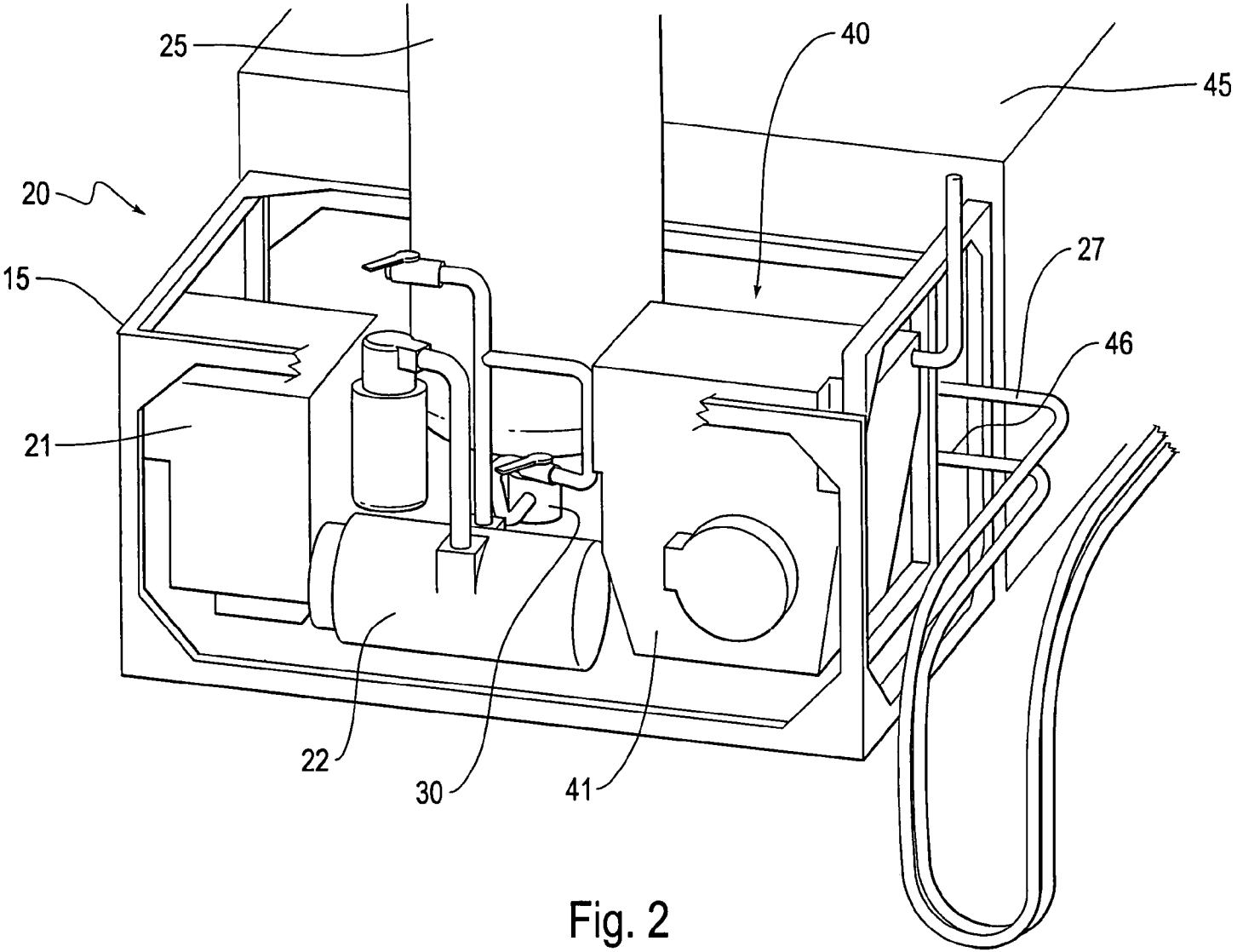
FIG. 2 is a close-up view of the vehicle-based system for dispensing an anti-traction, mobility denial material on a target surface shown in FIG. 1.
Figure 3:
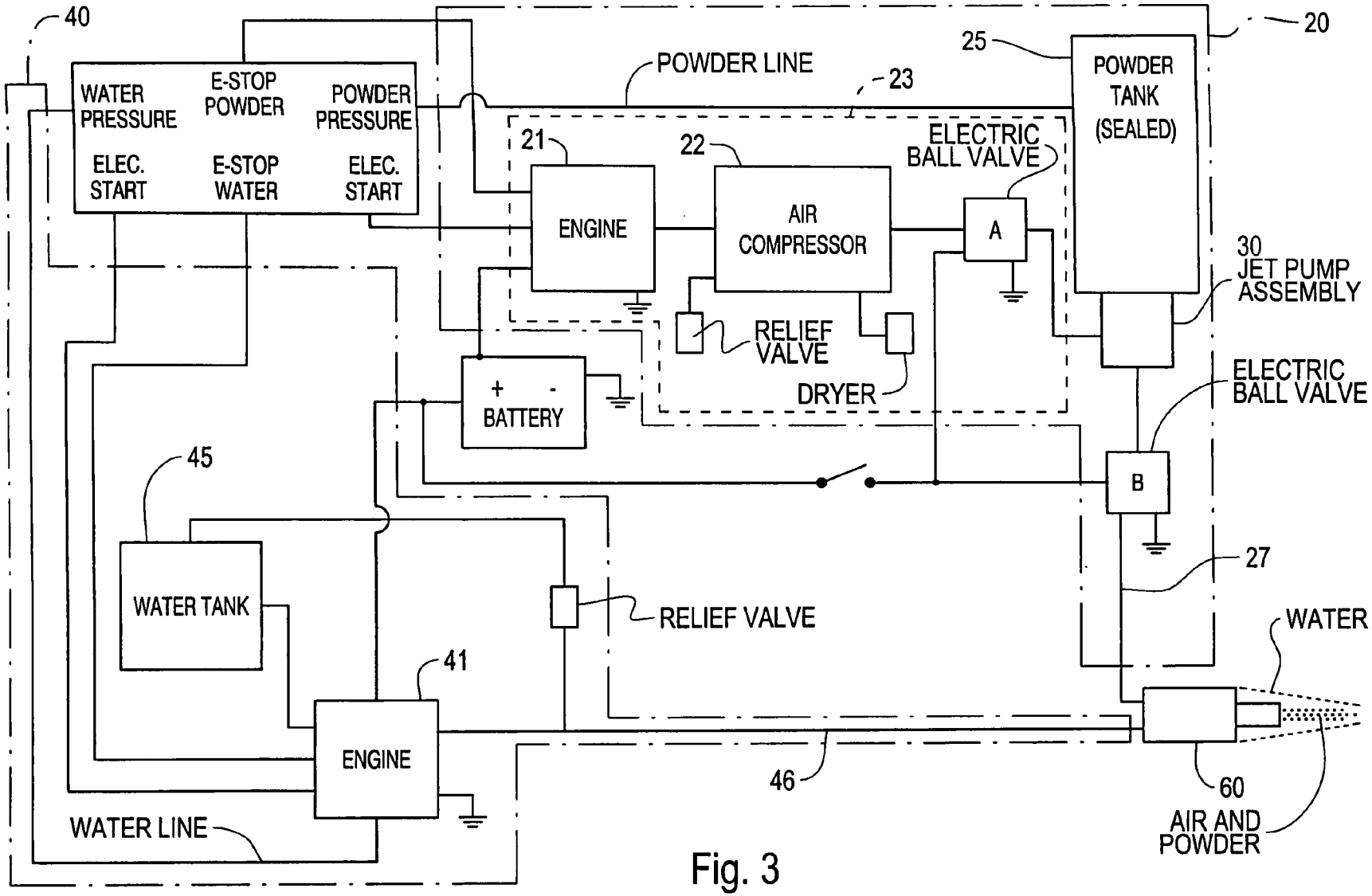
FIG. 3 is a schematic diagram of the vehicle-based system for dispensing an anti-traction, mobility denial material on a target surface shown in FIG. 1.

With reference to FIGS. 1-3, in various exemplary embodiments, the system 1 for dispensing an anti-traction, mobility denial material onto a surface includes a water dispensing sub-system 40. In one exemplary embodiment, the water dispensing sub-system 40 includes a diesel engine 41, such as, for example a 10 HP diesel engine, that pumps water from a 300 gallon storage tank 45 through a water hose 46 and to the dispensing nozzle 60 at a specific flow rate by weight.

In various exemplary embodiments, the dispensing nozzle 60 may include a firefighting equipment-type nozzle, such as, for example, a dual opening, Hydro-Chem nozzle HCHG-60-1.0 manufactured by Williams Fire & Hazard Control. As shown in FIG. 5, in various exemplary embodiments, the dispensing/discharge nozzle 60 includes a polymer powder dispensing section 61 and a water stream dispensing section 62, which maintain the physical separation of the two material fluid streams, i.e., polymer powder stream and water stream, until the two material streams exit the discharge nozzle 60. In one exemplary embodiment, the dispensing nozzle 60 has been modified to flow water within a range of approximately 22 to 30 gallons per minute (i.e., about 183 to about 249 pounds per minute) based upon the water dispensing system design requirements.

As discussed above, water and dry polymer powder each exit the dispensing/discharge nozzle 60 simultaneously from two different openings or sections of the dispensing nozzle, mix together per the predetermined ratio by weight per unit time, and then form a gel like anti-traction material (ATM) prior to, or shortly after being deposited on a horizontal, sloping or vertical surface. The different flow rate(s) of the water and polymer particle powder are each predetermined by the individual dispensing systems. In various exemplary embodiments, the ratio, by weight, of water to powder in the anti-traction material may range from approximately 8:1 to approximately 10:1.

In operation, the powder dispensing sub-system diesel engine powers the powder dispensing sub-system air compressor via the timing belt and reduction pulley assembly. In various exemplary embodiments, the speed of the diesel engine shaft is 3600 rpm while the speed on the air compressor is approximately 1800 rpm. Air is then pumped from the compressor 22, as shown in FIG. 2, through several pipes and fittings and into an annular venturi 35 inside the jet pump 31. The metal frame 15 (as shown in FIG. 1 and FIG. 2) to which the polymer powder dispensing sub-system 20 is attached, vibrates due to the operation of the polymer powder dispensing sub-system diesel engine 21 and water dispensing diesel engine 41. This free vibration provides a mechanical means for the dry powder to begin to flow down through openings 33*a*-33*c* formed in the powder metering nozzle 32, as shown in FIG. 4.

Typically, a low pressure condition, also known as Coanda Effect, occurs at the bottom 36 of the jet pump 31 due to free air flow from the top 37 to the bottom 36 of the jet pump 31. In the design of the powder dispensing sub-system shown in FIG. 4, however, the Coanda Effect is mitigated due to the sealed powder storage tank 25 and jet pump assembly 30. It will be noted that because of the above configuration, the powder storage tank 25 is pressurized slightly when the air compressor 22 is in operation after the polymer powder dispensing system 20 is started.

As the polymer particle powder moves down toward the bottom of the jet pump due to free vibration, the polymer powder 70 then mixes with the motive air 80 from the air compressor 22 and continues through the powder dispensing line 27 and through the dispensing nozzle 60.

One of the advantages of the system shown in FIG. 2 and FIG. 4 is the ability to generalize vibration of the powder tank 25 and powder metering nozzle 32 against a given delivery system. For example, free vibration from the 4.7 HP polymer powder dispensing subsystem diesel engine and the 10 HP water dispensing diesel engine provides enough shaking of the powder tank 25 to excite the flow of the powder 70 out of the powder tank 25 down toward annular jet pump venturi 35 and through the powder dispensing line to the dispensing nozzle 60.

It will be noted that free vibration may be correlated with accelerometer readings measured directly off the powder tank, the jet pump or the powder metering nozzle to generalize the use of other engine(s) with a given set of shock mounts. For example, is one exemplary embodiment, a 4.7 HP engine (3600 RPM) is used for powder flow and a 10 HP engine (3600 RPM) is used for water flow. Both diesel engines are attached to a common welded metal frame. Both engines have shock mounts that allow a given amount of vibration as a function of engine RPM. Both engines are running simultaneously on the frame while the system is in operation. Therefore, accelerometer readings may be measured in (G's) as a function of frequency (Hz) on the powder tank directly.

While the invention has been described in conjunction with the exemplary embodiments, these embodiments should be viewed as illustrative, not limiting. Various modifications, substitutes, or the like are possible within the spirit and scope of the invention.

What is claimed is:

1. A system for dispensing an anti-traction gel material on a target surface, comprising:

a dispensing nozzle having a polymer powder dispensing section and a water stream dispensing section;

a polymer powder dispensing system comprising;

a polymer particle storage tank comprising a polymer particle powder having a mean particle size distribution in a range of 0.025 mm to 0.400 mm;

a jet pump comprising an annular venturi disposed within a body of said jet pump defining a cavity in said jet pump;

a powder metering nozzle comprising:

an elongated hollow nozzle body having a substantially cylindrical lower section, a substantially conical upper section, and a base section configured to be attached to said jet pump; and a plurality of openings formed in the elongated hollow nozzle body and configured to flow the polymer particle powder from said polymer particular storage tank, through the openings away from the conical upper section and toward the lower section, and towards said annular venturi of said jet pump, wherein said plurality of openings comprises a first plurality of openings formed in a bottom section of the substantially cylindrical lower section, a second plurality of openings formed in a top section of the substantially cylindrical lower section, and a third plurality of openings formed in the substantially conical upper section;

wherein a ratio R1 of a combined surface area of the first and the second plurality of openings to a cross sectional area of said cavity in the jet pump is greater than about 1.5; and wherein a ratio R2 of a combined surface area of the third plurality of openings to said cross sectional area of said cavity in the jet pump is greater than about 0.25; and a compressed air system that provides motive air to transport the polymer particle powder from the polymer particle powder storage tank to the polymer powder dispensing section of the dispensing nozzle; and a water dispensing system that provides a water stream to the water stream dispensing section of the dispensing nozzle, wherein said water dispensing system, said polymer powder dispensing system and said dispensing nozzle are configured to maintain physical separation of the polymer particle powder and the water stream until the polymer particle powder and the water exit the dispensing nozzle and wherein said dispensing nozzle is further configured to mix the water stream with the polymer particle powder upon exit from said water stream dispensing section and said polymer powder dispensing section of the dispensing nozzle at a ratio of water to powder ranging from 7:1 to 16:1 by weight to form the anti-traction material.

2. The system according to claim 1, the polymer powder metering nozzle being able to aspirate with motive air a polymer particle powder having an angle of repose in a range of about 10 degrees to about 80 degrees.

3. The system according to claim 1, wherein the polymer powder metering nozzle controls a flow rate of the polymer particle powder out of the polymer particle powder storage tank to correspond to a flow rate of the water stream that provides a ratio of water to polymer particle powder in said range of 7:1 to 16:1 by weight upon exiting the dispensing nozzle.

4. The system according to 1, further comprising a frame, the polymer powder dispensing system and the water dispensing system being attached to the frame.

5. The system according to claim 4, wherein free vibration associated with operation of the polymer powder dispensing system or the water dispensing system provides sufficient shaking motion of the polymer powder storage tank and jet pump assembly to commence a flow of the polymer particle powder out of the polymer powder storage tank through the powder metering nozzle toward the venturi inside the jet pump assembly.

6. The system according to claim 1, wherein the polymer particles comprise acrylic polymer particles.

7. The system according to claim 1, wherein the polymer particles comprise acrylic polymer particles having a mean particle shape that is substantially irregular.

8. The system according to claim 1, wherein the polymer particles comprise acrylic polymer particles having a mean particle shape that is substantially spherical.

9. The system according to claim 1, wherein R1 is greater than about to 2.0.

10. The system according to claim 1, wherein R2 is greater than about to 0.5.

11. The system according to claim 1, wherein the plurality of openings are substantially elongated in a direction of the flow of powder through the powder metering nozzle.

12. The system according to claim 1, wherein the plurality of openings includes at least one opening formed tangential to the cylindrical lower section of the nozzle body.

* * * * *